US008955276B2

(12) United States Patent
Wall et al.

(10) Patent No.: US 8,955,276 B2
(45) Date of Patent: Feb. 17, 2015

(54) RAISED FLOORING APPARATUS AND SYSTEM

(76) Inventors: Steven James Wall, Owasso, OK (US); Lenny J McCall, Owasso, OK (US)

( * ) Notice: Subject to any disclaimer, the term of this patent is extended or adjusted under 35 U.S.C. 154(b) by 0 days.

(21) Appl. No.: 13/357,658

(22) Filed: Jan. 25, 2012

(65) Prior Publication Data

US 2013/0186014 A1 Jul. 25, 2013

(51) Int. Cl.
*E04F 15/024* (2006.01)

(52) U.S. Cl.
USPC ..... 52/263; 52/126.5; 52/126.6; 52/483.1

(58) Field of Classification Search
USPC ..... 52/126.5, 126.6, 263, 483.1
See application file for complete search history.

(56) References Cited

U.S. PATENT DOCUMENTS

| | | | | | |
|---|---|---|---|---|---|
| 748,603 | A | * | 1/1904 | Henry | 52/590.1 |
| 3,360,896 | A | * | 1/1968 | Wright | 52/506.09 |
| 3,811,237 | A | * | 5/1974 | Bettinger | 52/126.6 |
| 3,857,216 | A | * | 12/1974 | Sherman | 52/506.06 |
| 4,067,156 | A | * | 1/1978 | Downing, Jr. | 52/126.6 |
| 4,147,006 | A | * | 4/1979 | Kruschwitz | 52/204.599 |
| 4,294,156 | A | * | 10/1981 | McSherry et al. | 411/345 |
| 4,578,910 | A | * | 4/1986 | Germeroth et al. | 52/105 |
| 4,621,468 | A | * | 11/1986 | Likozar | 52/126.6 |
| 4,691,491 | A | * | 9/1987 | Lilley | 52/22 |
| 4,736,555 | A | * | 4/1988 | Nagare et al. | 52/126.6 |
| 4,838,000 | A | * | 6/1989 | Ljungkvist | 52/376 |
| 4,858,408 | A | * | 8/1989 | Dunn | 52/506.07 |
| 4,883,503 | A | * | 11/1989 | Fish | 52/263 |
| 4,922,670 | A | * | 5/1990 | Naka et al. | 52/126.6 |
| 5,090,169 | A | * | 2/1992 | Takeda et al. | 52/220.3 |
| 5,333,423 | A | * | 8/1994 | Propst | 52/126.6 |
| 5,525,007 | A | * | 6/1996 | Jones et al. | 405/52 |
| 5,787,663 | A | * | 8/1998 | Wehrmann | 52/263 |
| 5,822,918 | A | * | 10/1998 | Helfman et al. | 47/39 |
| 6,141,927 | A | * | 11/2000 | Usui | 52/263 |
| 6,161,984 | A | * | 12/2000 | Sinclair | 404/25 |
| 6,226,952 | B1 | * | 5/2001 | Romeu Guardia | 52/698 |
| 6,354,048 | B1 | * | 3/2002 | Gillett et al. | 52/220.1 |
| 7,302,778 | B2 | * | 12/2007 | MacMillan | 52/169.9 |
| 7,546,715 | B2 | * | 6/2009 | Roen | 52/506.05 |
| 7,644,550 | B2 | * | 1/2010 | Meyer | 52/263 |
| 7,758,011 | B2 | * | 7/2010 | Haddock | 248/500 |
| 7,866,096 | B2 | * | 1/2011 | Lee et al. | 52/126.6 |
| 8,397,443 | B2 | * | 3/2013 | Blom et al. | 52/126.7 |
| 8,453,391 | B2 | * | 6/2013 | Tabibnia | 52/126.6 |
| 8,505,864 | B1 | * | 8/2013 | Taylor et al. | 248/237 |
| 8,578,671 | B2 | * | 11/2013 | Labrecque et al. | 52/395 |
| 8,627,617 | B2 | * | 1/2014 | Haddock et al. | 52/173.3 |
| 8,683,751 | B2 | * | 4/2014 | Stearns | 52/58 |
| 2002/0144477 | A1 | * | 10/2002 | Chen | 52/263 |
| 2002/0148173 | A1 | * | 10/2002 | Kugler | 52/126.6 |
| 2006/0131465 | A1 | * | 6/2006 | Lynch et al. | 248/68.1 |
| 2006/0248814 | A1 | * | 11/2006 | Chen et al. | 52/126.6 |

(Continued)

FOREIGN PATENT DOCUMENTS

| | | | | |
|---|---|---|---|---|
| EP | 0483417 | A1 | * | 5/1992 |
| FR | 2506379 | A | * | 11/1982 |

(Continued)

*Primary Examiner* — Robert Canfield
*Assistant Examiner* — Charissa Ahmad
(74) *Attorney, Agent, or Firm* — Cornelius P. Dukelow

(57) ABSTRACT

The raised flooring apparatus and system may be used to construct a raised floor directly onto joists while accommodating commonly accepted building practices utilizing 16" and 24" center to center joist spacing.

10 Claims, 9 Drawing Sheets

(56) References Cited

U.S. PATENT DOCUMENTS

| | | | | |
|---|---|---|---|---|
| 2007/0193145 | A1* | 8/2007 | Wheatley | 52/263 |
| 2009/0241440 | A1* | 10/2009 | Musser | 52/169.5 |
| 2010/0263304 | A1* | 10/2010 | Torrents I Comas | 52/126.5 |
| 2013/0167456 | A1* | 7/2013 | Shapiro | 52/126.3 |

FOREIGN PATENT DOCUMENTS

| | | | | |
|---|---|---|---|---|
| FR | 2702506 | A1 * | 9/1994 | E04F 15/024 |
| FR | 2716695 | A1 * | 9/1995 | E06B 3/26 |
| GB | 2417503 | A * | 3/2006 | |

* cited by examiner

RAISED FLOORING APPARATUS AND SYSTEM

CROSS-REFERENCE TO RELATED APPLICATIONS

N/A

STATEMENT REGARDING FEDERALLY SPONSORED RESEARCH OR DEVELOPMENT

N/A

THE NAMES OF THE PARTIES TO A JOINT RESEARCH AGREEMENT

N/A

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

N/A

BACKGROUND OF THE ART

1. Field of the Art

The present art relates generally to flooring. More particularly, the present art relates to a raised flooring apparatus and system.

2. Description of Related Art

Related art may be found in U.S. Class 52.

BRIEF SUMMARY OF THE RAISED FLOORING APPARATUS AND SYSTEM

The raised flooring apparatus and system may be used to construct a raised floor directly onto joists while accommodating commonly accepted building practices utilizing 16" and 24" center to center joist spacing.

The raised flooring apparatus and system was designed for simple installation. It may be installed by placing risers (in tandem with riser mounting bases) throughout the area to be floored upon which floor planks may be mounted and secured into place by a top plate and mounting pin. The flooring may be raised to a desired height by placing riser lifting blocks between the riser mounting bases and risers.

BRIEF DESCRIPTION OF THE SEVERAL VIEWS OF THE DRAWINGS

A preferred embodiment of the raised flooring apparatus and system is described in detail below with reference to the attached drawing figures, wherein.

DETAILED DESCRIPTION OF THE RAISED FLOORING APPARATUS AND SYSTEM

The embodiments discussed herein are merely illustrative of specific manners in which to make and use the raised flooring apparatus and system and are not to be interpreted as limiting the scope of the raised flooring apparatus and system.

Figure 1:
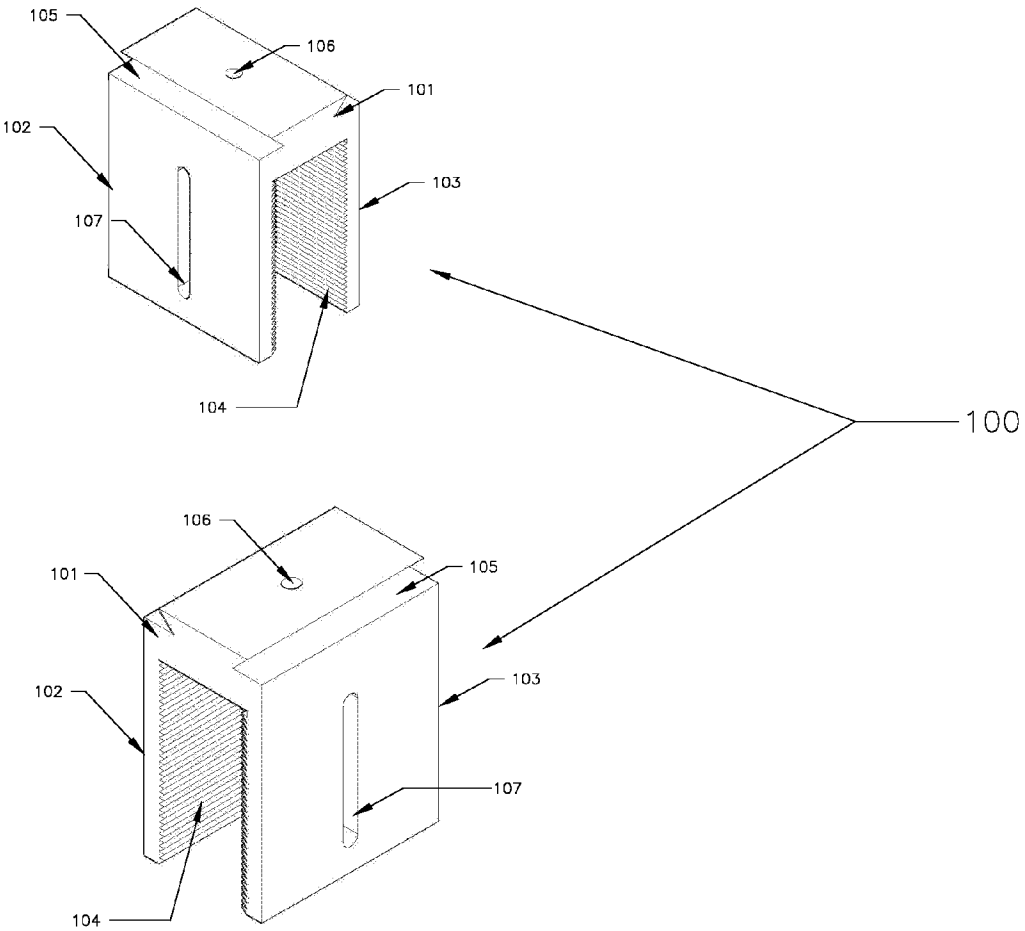
FIG. 1 illustrates an embodiment of the riser mounting base.

Referring to the drawings in detail, FIG. 1 illustrates an embodiment of the riser mounting base [100]. The riser mounting base is of a generally upside down U shape configuration having a top portion [101] and a first side portion [102] and second side portion [103]. The first side portion and second side portion extend from the top portion being generally parallel to each other and perpendicular to the top portion. The space between the first side portion and second side portion and underneath the top portion form a cavity. The interior or cavity facing sides of the first side portion and second side portion may include teeth [104]. At least one notch or groove for mating with a riser or riser lifting block is provided in the exterior or top side of the top portion or the exterior of the first side portion and/or second side portion [105]. Top mounting apertures [106] may be provided in the top portion allowing for the insertion of a mounting pin, screw, nail, or other similar fastener. Side mounting apertures [107] may also be provided the first side portion and the second side portion allowing for the insertion of a mounting pin, screw, nail, or other similar fastener.

In one embodiment, the riser mounting base is formed as a unitary component made of a plastic material. Plastic material, plastic resin, or durable polyamide polymer that cannot be easily deformed or broken would be suitable for forming the riser mounting base. An injection mold in conjunction with a mold press may be utilized to form the riser mounting base. In general, plastic injection molding processes are known, and further description is not believed necessary.

Figure 2:
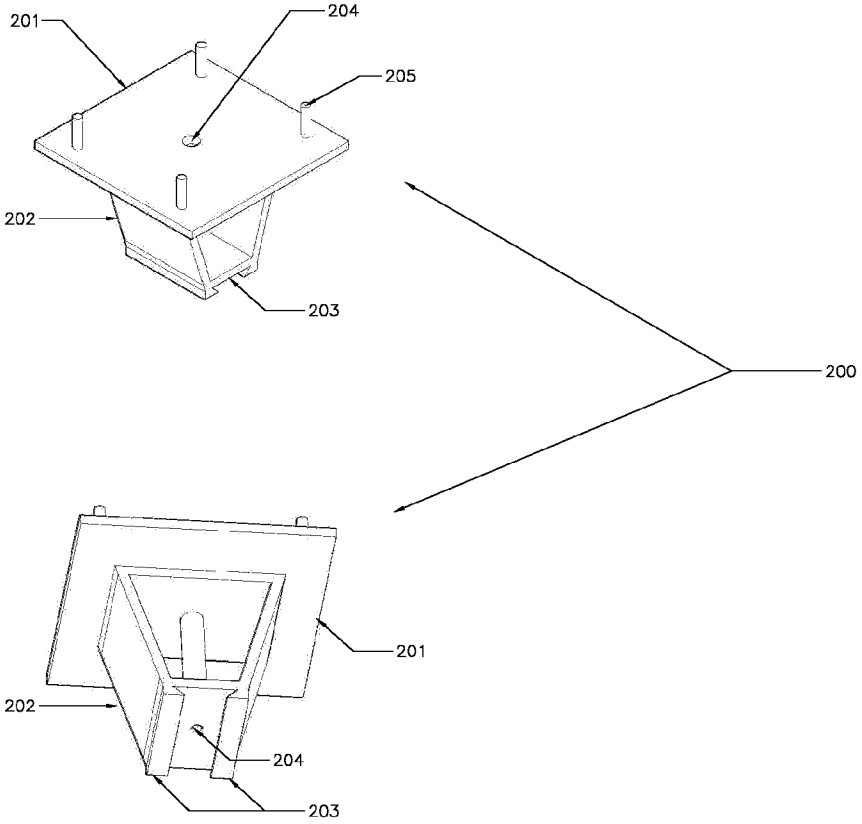
FIG. 2 illustrates an embodiment of the riser.

FIG. 2 illustrates an embodiment of the riser [200]. The riser provides a generally flat top portion [201] and a bottom portion [202]. The bottom portion provides at least one notch or groove [203] for mating with a riser mounting base or riser lifting block. Mounting apertures [204] may be provided traversing the riser allowing for the insertion of a mounting pin, screw, nail, or other similar fastener. Riser fingers [205] may be provided protruding from the top portion or mating with a floor plank.

In one embodiment, the riser is formed as a unitary component made of a plastic material. Plastic material, plastic resin, or durable polyamide polymer that cannot be easily deformed or broken would be suitable for forming the riser. An injection mold in conjunction with a mold press may be utilized to form the riser. In general, plastic injection molding processes are known, and further description is not believed necessary.

Figure 3:
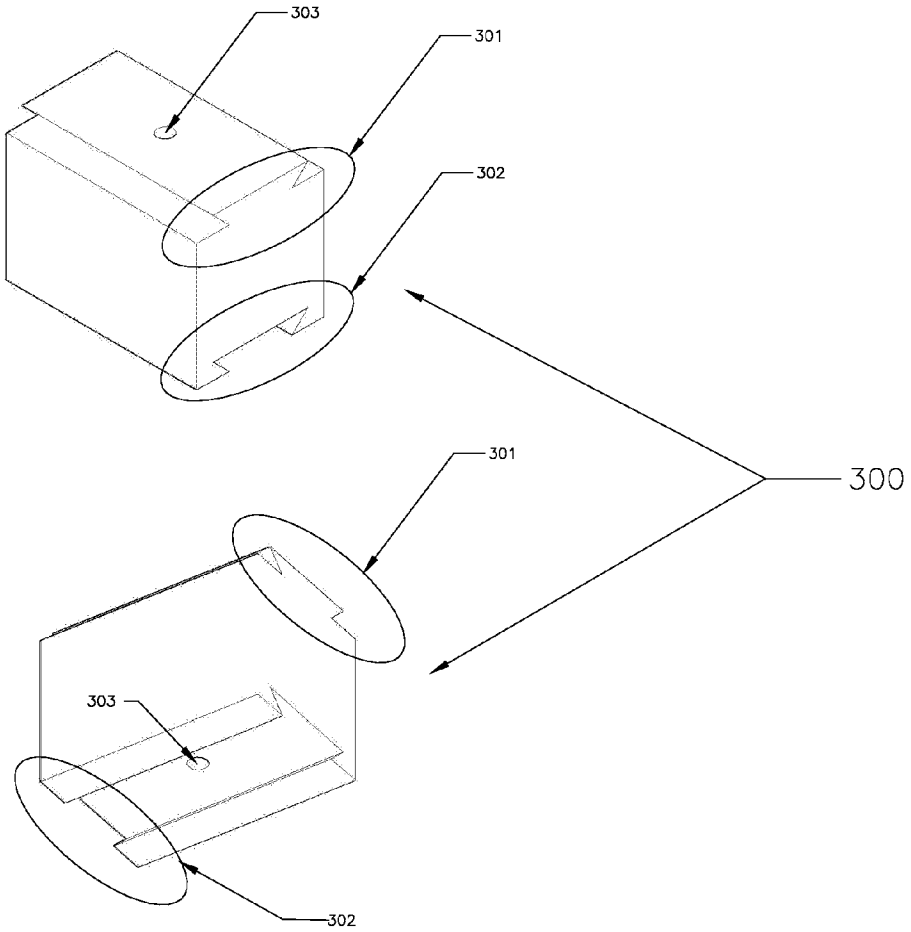
FIG. 3 illustrates an embodiment of the riser lifting block.

FIG. 3 illustrates an embodiment of the riser lifting block [300]. The riser lifting block provides at least one notch or groove on the top side [301] and at least one notch or groove on the bottom side [302] for mating with a riser mounting base, riser or another riser lifting block. Mounting apertures [303] may be provided traversing the riser lifting block allowing for the insertion of a mounting pin, screw, nail, or other similar fastener.

In one embodiment, the riser lifting block is formed as a unitary component made of a plastic material. Plastic material, plastic resin, or durable polyamide polymer that cannot be easily deformed or broken would be suitable for forming the riser lifting block. An injection mold in conjunction with a mold press may be utilized to form the riser lifting block. In general, plastic injection molding processes are known, and further description is not believed necessary.

Figure 4:
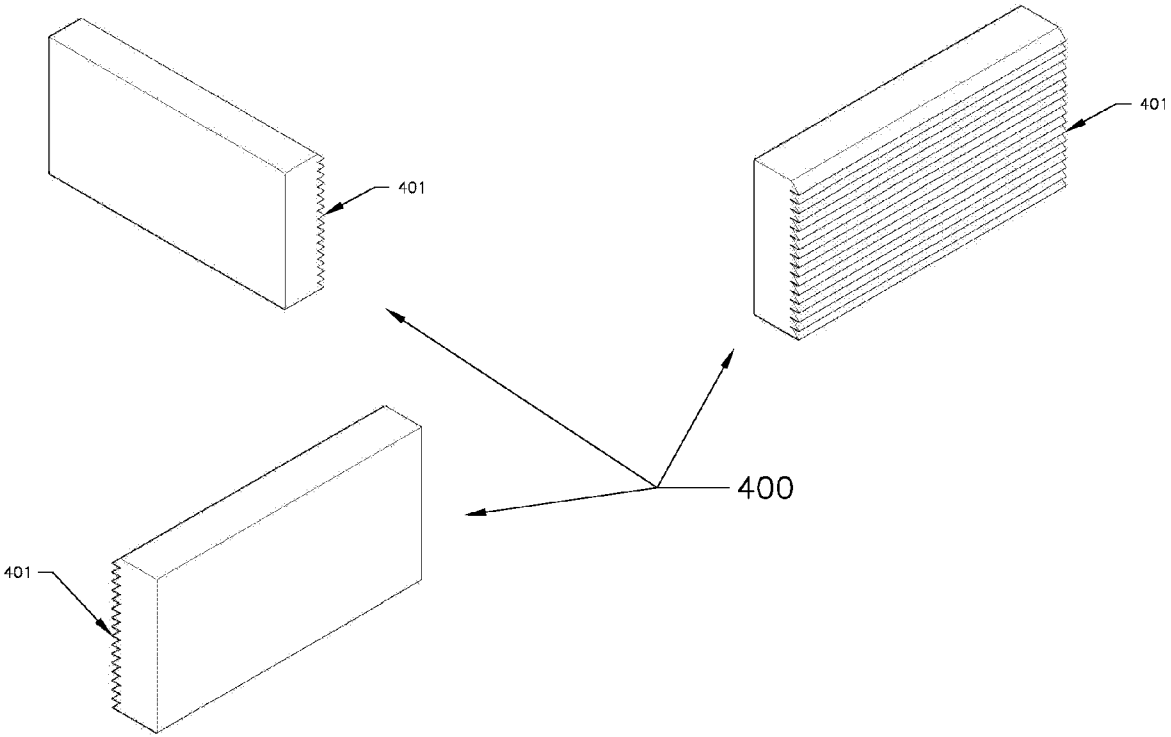
FIG. 4 illustrates an embodiment of the narrow beam block.

FIG. 4 illustrates an embodiment of the narrow beam block [400]. The narrow beam block is formed to fit into the cavity of the riser mounting base and is used to reduce the size of the cavity. The narrow beam block may include teeth [401].

In one embodiment, the narrow beam block is formed as a unitary component made of a plastic material. Plastic material, plastic resin, or durable polyamide polymer that cannot be easily deformed or broken would be suitable for forming the narrow beam block. An injection mold in conjunction with a mold press may be utilized to form the narrow beam block. In general, plastic injection molding processes are known, and further description is not believed necessary.

Figure 5:
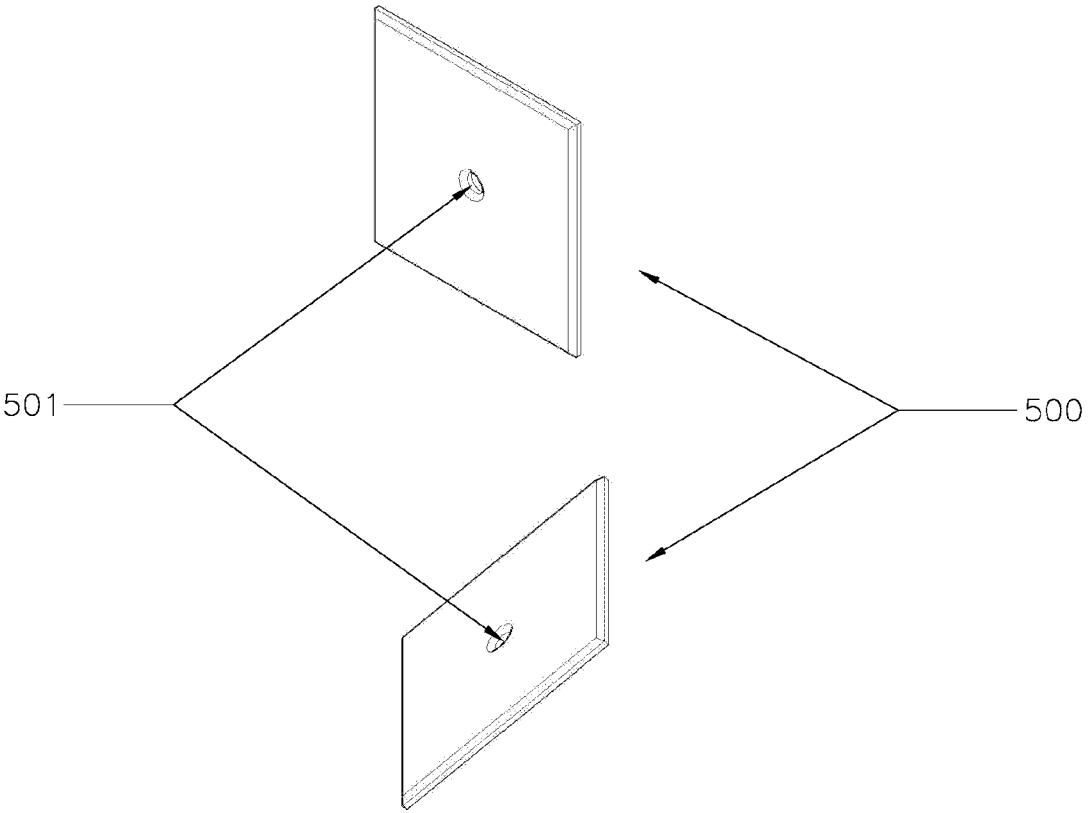
FIG. 5 illustrates an embodiment of the top plate.

FIG. 5 illustrates an embodiment of the top plate [500]. The top plate is generally flat and may provide an aperture [501] therein allowing for the insertion of a mounting pin, screw, nail or other similar fastener.

In one embodiment, the top plate is formed as a unitary component made of a plastic material. Plastic material, plastic resin, or durable polyamide polymer that cannot be easily deformed or broken would be suitable for forming the top plate. An injection mold in conjunction with a mold press may be utilized to form the top plate. In general, plastic injection molding processes are known, and further description is not believed necessary.

Figure 6:
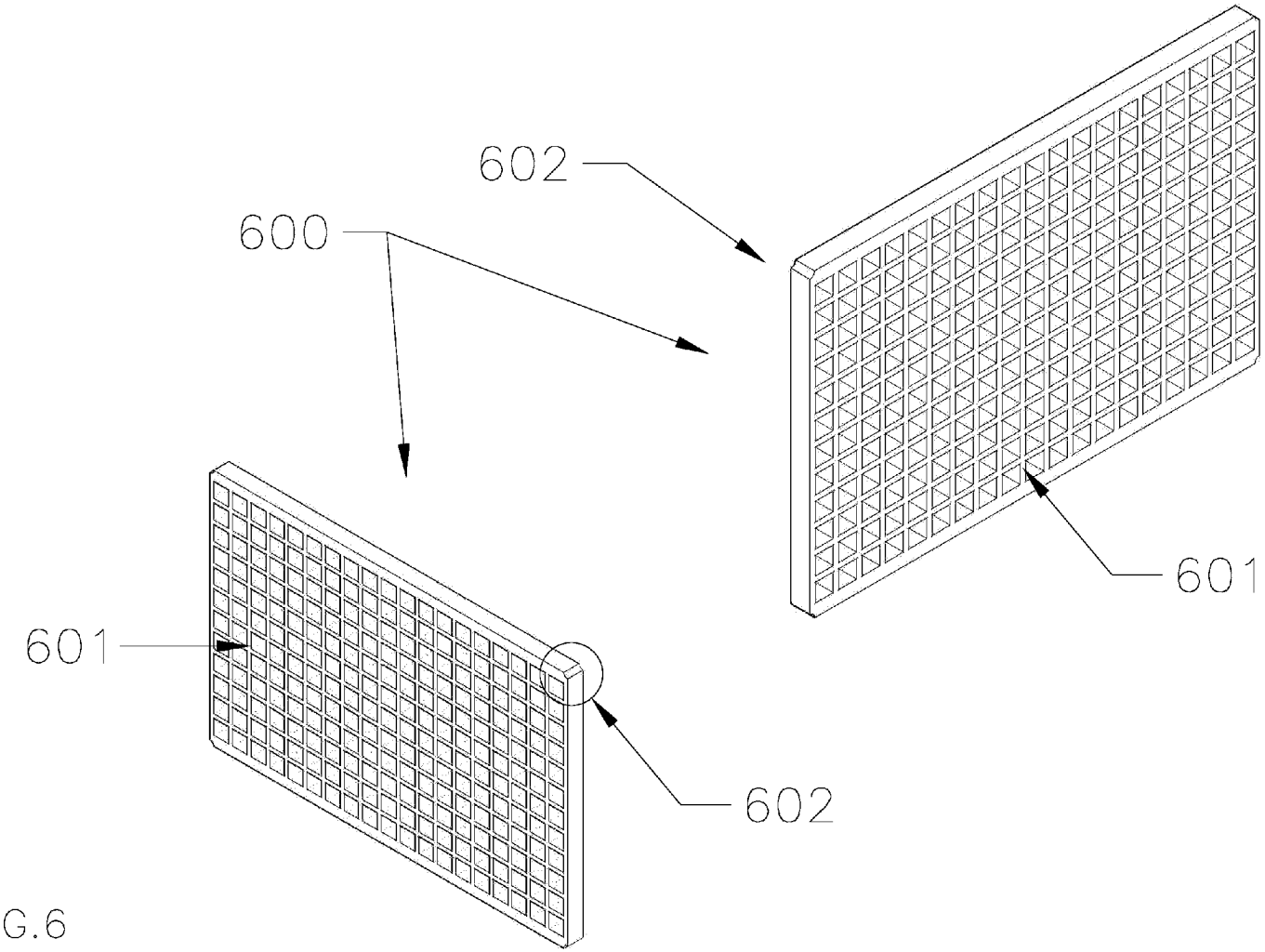
FIG. 6 illustrates an embodiment of the floor plank.

FIG. 6 illustrates an embodiment of the floor plank [600]. The floor plank is generally flat and may include apertures [601]. Although the floor plank may be any shape or dimensions, its preferred embodiment is a 16"×24" rectangle. The floor plank may also include nubs [602] at the corners to accommodate insertion of a mounting pin, screw, nail, or other similar fastener.

In one embodiment, the floor plank is formed as a unitary component made of a plastic material. Plastic material, plastic resin, or durable polyamide polymer that cannot be easily deformed or broken would be suitable for forming the floor plank. An injection mold in conjunction with a mold press may be utilized to form the floor plank. In general, plastic injection molding processes are known, and further description is not believed necessary.

Figure 7:
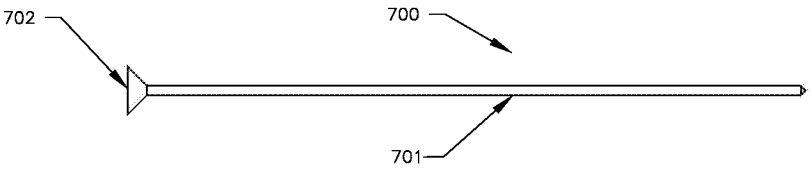
FIG. 7 illustrates an embodiment of the mounting pin.

FIG. 7 illustrates an embodiment of the mounting pin [700]. The mounting pin includes a generally straight body [701] and a head [702] at one end of the body. The body is of a size permitting it to traverse apertures that may be present in the top plate, riser, riser lifting block and riser mounting base. The head is generally flat and of a size prohibiting it from traversing apertures that may be present in the top plate, riser, riser lifting block and riser mounting base.

In one embodiment, the mounting pin is formed as a unitary component made of a metal material. A metal material that cannot be easily deformed or broken would be suitable for forming the mounting pin. In general, metal pin and nail manufacturing processes are known, and further description is not believed necessary.

Figure 8:
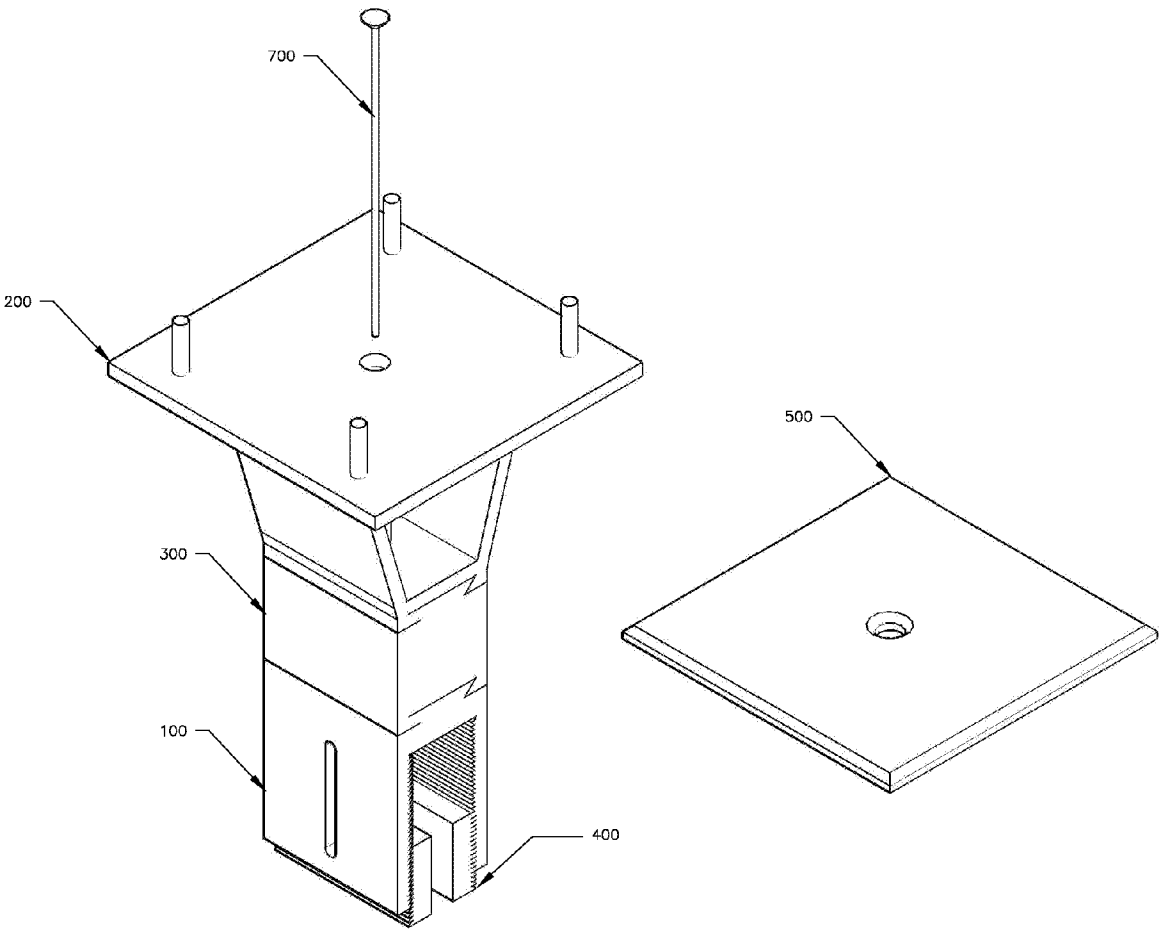
FIG. 8 illustrates an embodiment of the raised flooring apparatus and system as assembled.
Figure 9:
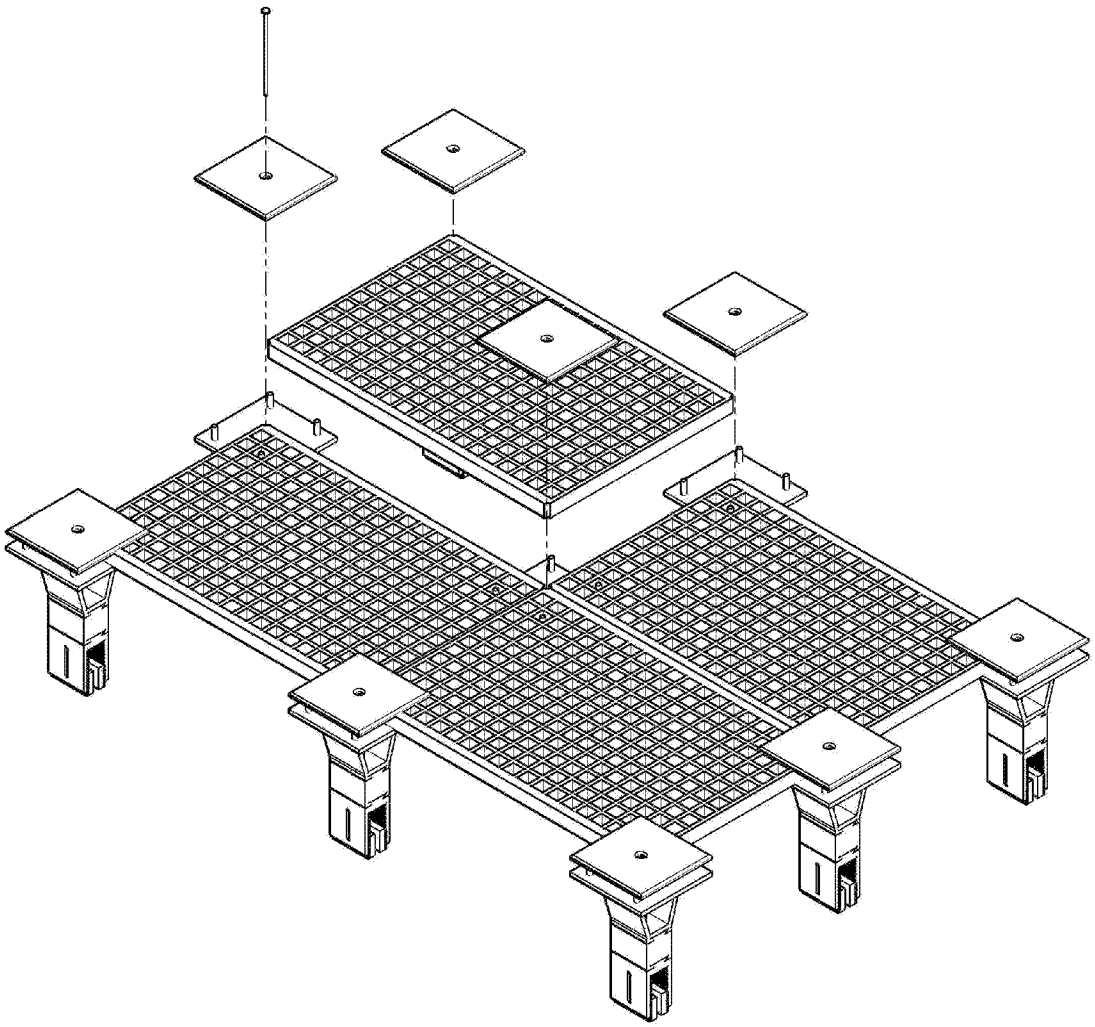
FIG. 9 illustrates an embodiment of the raised flooring apparatus and system as assembled.

FIGS. 8 & 9 illustrate embodiments of the raised flooring apparatus and system as assembled for use.

While the raised flooring apparatus and system has been described with a certain degree of particularity, it is to be noted that modifications may be made in the details of the raised flooring apparatus and system's construction and the arrangement of its components without departing from the spirit and scope of this disclosure. It is understood that the raised flooring apparatus and system is not limited to the embodiments set forth herein for the purposes of exemplification.

What is claimed is:

1. An apparatus comprising:

(a) a riser mounting base having a top portion with a top surface and a bottom surface;

(b) an aperture extending from said top surface of said top portion of said riser mounting base to said bottom surface of said top portion of said riser mounting base;

(c) a first side portion with an inner surface and an outer surface and second side portion with an inner surface and an outer surface extending downwardly from said bottom surface of said top portion of said riser mounting base and spaced apart from each other, said first and second side portions being parallel to each other and perpendicular to said bottom surface of said top portion of said riser mounting base, said inner surfaces of said first and second side portions facing each other;

(d) a plurality of horizontal teeth on said inner surfaces of said first and second side portions;

(e) at least one aperture extending from said outer surfaces to said inner surfaces of said first and second side portions;

(f) a riser lifting block having a top surface and a bottom surface mounted directly on said top surface of said top portion of said riser mounting base via a tongue and groove joint;

(g) an aperture extending from said top surface of said riser lifting block to said bottom surface of said riser lifting block;

(h) a riser having a top surface and a bottom surface mounted directly on said top surface of said riser lifting block via a tongue and groove joint;

(i) an aperture extending from said top surface of said riser to said bottom surface of said riser;

(j) a plurality of protrusions protruding from said top surface of said riser;

(k) a top plate detachably mountable on said riser;

(l) an aperture in said top plate;

(m) a mounting pin for fastening said top plate to said riser;

(n) a floor plank detachably mountable between said top plate and said riser; and (o) at least one toothed narrow beam block detachably mountable on at least one of said inner surfaces of said first and second side portions of said riser mounting base.

2. An apparatus comprising:

(a) a riser mounting base having a top portion with a top surface and a bottom surface;

(b) a first side portion with an inner surface and an outer surface and second side portion with an inner surface and an outer surface extending downwardly from said bottom surface of said top portion of said riser mounting base and spaced apart from each other, said first and second side portions being parallel to each other and perpendicular to said bottom surface of said top portion of said riser mounting base, said inner surfaces of said first and second side portions facing each other;

(c) a riser lifting block having a top surface and a bottom surface mounted directly on said to surface of said to portion of said riser mounting base via a tongue and groove joint;

(d) an aperture extending from said to surface of said riser lifting block to said bottom surface of said riser lifting block;

(e) a riser having a top surface and a bottom surface mounted directly on said top surface of said riser lifting block via a tongue and groove joint;

(f) a top plate detachably mountable on said riser; and (g) a plurality of horizontal teeth on said inner surfaces of said first and second side portions.

3. The apparatus of claim 2 further comprising:

(a) an aperture extending from said top surface of said top portion of said riser mounting base to said bottom surface of said top portion of said riser mounting base.

4. The apparatus of claim 2 further comprising:

(a) at least one aperture extending from said outer surfaces to said inner surfaces of said first and second side portions.

5. The apparatus of claim 2 further comprising:

(a) an aperture extending from said top surface of said riser to said bottom surface of said riser.

6. The apparatus of claim 2 further comprising:

(a) a plurality of protrusions protruding from said top surface of said riser.

7. The apparatus of claim 2 further comprising:

(a) an aperture in said top plate.

8. The apparatus of claim 2 further comprising:

(a) a mounting pin for fastening said top plate to said riser.

9. The apparatus of claim 2 further comprising:

(a) a floor plank detachably mountable between said top plate and said riser.

10. The apparatus of claim 2 further comprising:

(a) at least one toothed narrow beam block detachably mountable on at least one of said inner surfaces of said first and second side portions of said riser mounting base.

* * * * *